US006564524B1

(12) United States Patent
Gruita

(10) Patent No.: US 6,564,524 B1
(45) Date of Patent: May 20, 2003

(54) MODULAR CONSTRUCTION SYSTEM

(76) Inventor: Christian Gruita, 2218 Nicollete Ave., North #25, Minneapolis, MN (US) 55404

( * ) Notice: Subject to any disclaimer, the term of this patent is extended or adjusted under 35 U.S.C. 154(b) by 0 days.

(21) Appl. No.: 09/904,775

(22) Filed: Jul. 13, 2001

(51) Int. Cl.[7] ..... E04C 2/04

(52) U.S. Cl. ..... 52/604; 52/311.1; 52/311.2; 52/314; 52/405; 52/585.1; 52/590.2; 52/592.1; 52/592.6; 52/603; 52/605

(58) Field of Search ..... 52/604, 605, 603, 52/592.6, 590.2, 405, 585.1, 592.1, 311.1, 311.2, 314

(56) References Cited

U.S. PATENT DOCUMENTS

| | | | | | |
|---|---|---|---|---|---|
| 2,291,712 | A | | 8/1942 | Hatton | |
| 3,102,367 | A | | 9/1963 | Pedersen et al. | |
| 3,292,331 | A | * | 12/1966 | Sams | 52/405 |
| 3,782,049 | A | * | 1/1974 | Sachs | 52/309.12 |
| 4,226,061 | A | * | 10/1980 | Day, Jr. | 52/125.2 |
| D266,361 | S | | 9/1982 | Coelho Dos Santos | |
| 4,510,725 | A | | 4/1985 | Wilson | |
| 4,677,806 | A | | 7/1987 | Tuomi | |
| 5,014,488 | A | * | 5/1991 | Evangelos et al. | 52/746.12 |
| 5,017,049 | A | * | 5/1991 | Sievert | 405/284 |
| 5,159,801 | A | * | 11/1992 | Schmidt | 52/575 |
| 5,181,362 | A | | 1/1993 | Benitez | |
| 5,285,610 | A | | 2/1994 | Schaaf et al. | |
| 5,788,423 | A | * | 8/1998 | Perkins | 405/284 |
| 5,960,604 | A | * | 10/1999 | Blanton | 52/590.2 |
| 6,000,183 | A | * | 12/1999 | Newman | 52/311.1 |
| 6,088,987 | A | * | 7/2000 | Simmons et al. | 405/285 |

FOREIGN PATENT DOCUMENTS

| | | | | |
|---|---|---|---|---|
| DE | 2405331 | * | 8/1974 | 52/605 |
| FR | 825.383 | * | 6/1939 | 52/592.6 |
| JP | 0047441 | * | 2/1990 | 52/604 |

* cited by examiner

*Primary Examiner*—Carl D. Friedman
*Assistant Examiner*—Christy M. Green

(57) ABSTRACT

A modular construction system for reducing costs and improving the long term structural integrity of buildings. The modular construction system includes a plurality of lateral members which are stackable and couplable end-to-end with other lateral members, a plurality of anchor members which are couplable to a foundation of a building and include an eye portion, a plurality of anchor segments which include a hook portion for engaging the eye portion of the anchor member and are positionable through a bore of the lateral members for securing the lateral members to the foundation, and a plurality of fastener members which are each couplable to an associated one of the anchor segments to prevent the lateral members from being lifted away from the foundation.

17 Claims, 3 Drawing Sheets

MODULAR CONSTRUCTION SYSTEM

BACKGROUND OF THE INVENTION

1. Field of the Invention

The present invention relates to building blocks and more particularly pertains to a new modular construction system for reducing costs and improving the long term structural integrity of buildings.

2. Description of the Prior Art

The use of building blocks is known in the prior art. More specifically, building blocks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,285,610; U.S. Pat. No. 4,677,806; U.S. Pat. No. 4,510,725; U.S. Pat. No. 3,102,367; U.S. Pat. No. 2,291,712; U.S. Pat. No. Des. 266,361; and U.S. Pat. No. 5,181,362.

While these devices fulfill their respective, particular objectives and requirements, the aforementioned patents do not disclose a new modular construction system. The inventive device includes a plurality of lateral members which are stackable and couplable end-to-end with other lateral members, a plurality of anchor members which are couplable to a foundation of a building and include an eye portion, a plurality of anchor segments which include a hook portion for engaging the eye portion of the anchor member and are positionable through a bore of the lateral members for securing the lateral members to the foundation, and a plurality of fastener members which are each couplable to an associated one of the anchor segments to prevent the lateral members from being lifted away from the foundation.

In these respects, the modular construction system according to the present invention substantially departs from the conventional concepts and designs of the prior art, and in so doing provides an apparatus primarily developed for the purpose of reducing costs and improving the long term structural integrity of buildings.

SUMMARY OF THE INVENTION

In view of the foregoing disadvantages inherent in the known types of building blocks now present in the prior art, the present invention provides a new modular construction system construction wherein the same can be utilized for reducing costs and improving the long term structural integrity of buildings.

The general purpose of the present invention, which will be described subsequently in greater detail, is to provide a new modular construction system apparatus and method which has many of the advantages of the building blocks mentioned heretofore and many novel features that result in a new modular construction system which is not anticipated, rendered obvious, suggested, or even implied by any of the prior art building blocks, either alone or in any combination thereof.

To attain this, the present invention generally comprises a plurality of lateral members which are stackable and couplable end-to-end with other lateral members, a plurality of anchor members which are couplable to a foundation of a building and include an eye portion, a plurality of anchor segments which include a hook portion for engaging the eye portion of the anchor member and are positionable through a bore of the lateral members for securing the lateral members to the foundation, and a plurality of fastener members which are each couplable to an associated one of the anchor segments to prevent the lateral members from being lifted away from the foundation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new modular construction system apparatus and method which has many of the advantages of the building blocks mentioned heretofore and many novel features that result in a new modular construction system which is not anticipated, rendered obvious, suggested, or even implied by any of the prior art building blocks, either alone or in any combination thereof.

It is another object of the present invention to provide a new modular construction system which may be easily and efficiently manufactured and marketed.

It is a further object of the present invention to provide a new modular construction system which is of a durable and reliable construction.

An even further object of the present invention is to provide a new modular construction system which is susceptible of a low cost of manufacture with regard to both materials and labor, and which accordingly is then susceptible of low prices of sale to the consuming public, thereby making such modular construction system economically available to the buying public.

Still yet another object of the present invention is to provide a new modular construction system which provides in the apparatuses and methods of the prior art some of the advantages thereof, while simultaneously overcoming some of the disadvantages normally associated therewith.

Still another object of the present invention is to provide a new modular construction system for reducing costs and improving the long term structural integrity of buildings.

Yet another object of the present invention is to provide a new modular construction system which includes a plurality of lateral members which are stackable and couplable end-to-end with other lateral members, a plurality of anchor members which are couplable to a foundation of a building and include an eye portion, a plurality of anchor segments which include a hook portion for engaging the eye portion of the anchor member and are positionable through a bore of the lateral members for securing the lateral members to the foundation, and a plurality of fastener members which are each couplable to an associated one of the anchor segments to prevent the lateral members from being lifted away from the foundation.

Still yet another object of the present invention is to provide a new modular construction system that can be manufactured from recycled materials.

Even still another object of the present invention is to provide a new modular construction system that controls the slope of buildings during settling.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
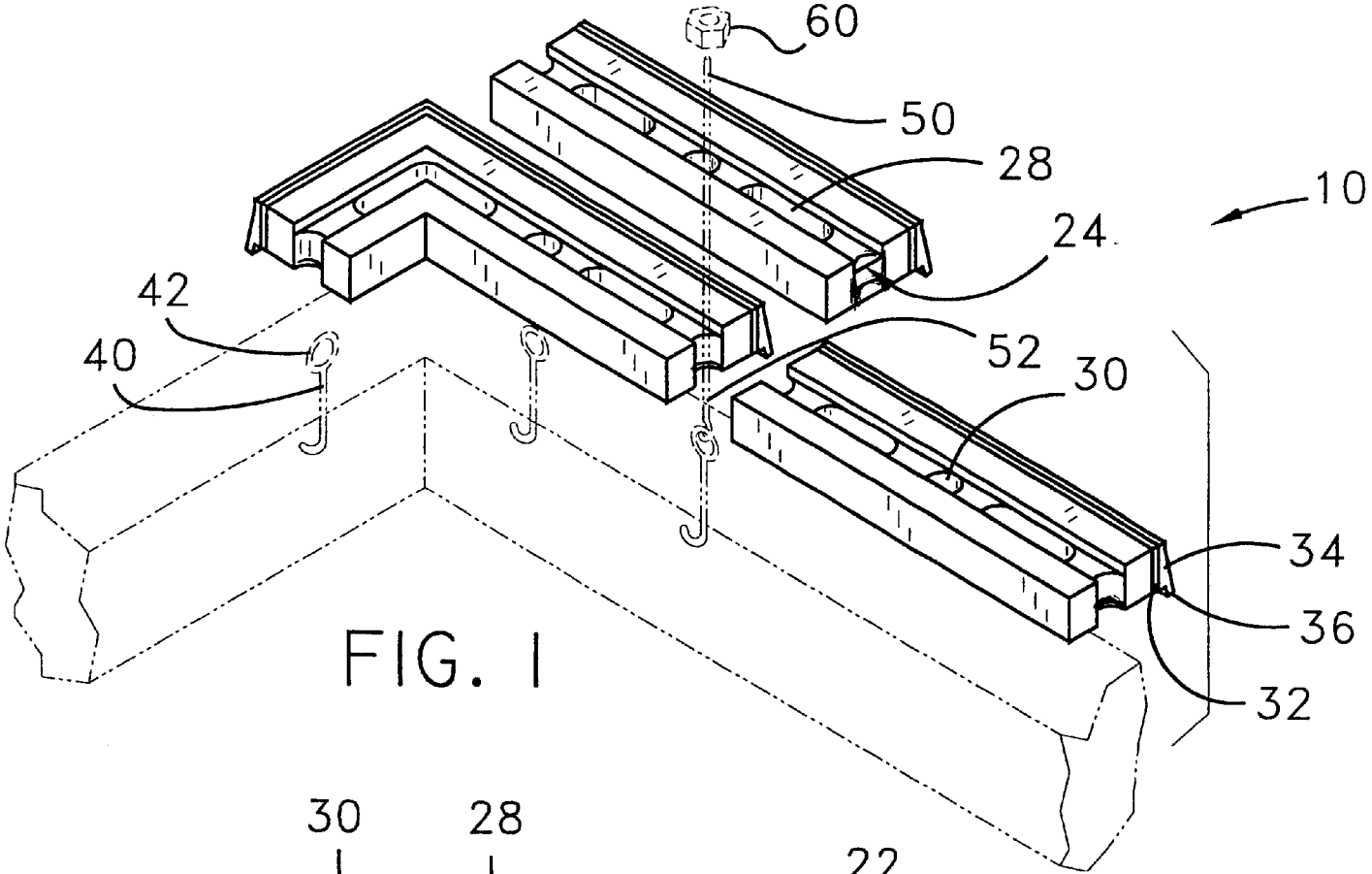
FIG. 1 is a schematic perspective view of a new modular construction system according to the present invention.
Figure 6:
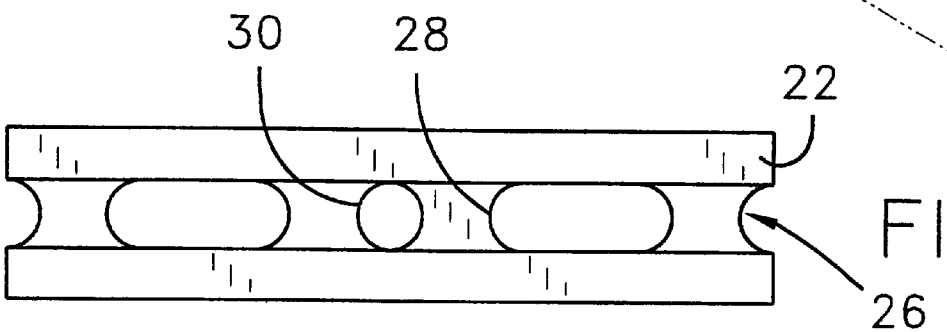
FIG. 6 is a schematic bottom view of a lateral member of the present invention.
Figure 2:
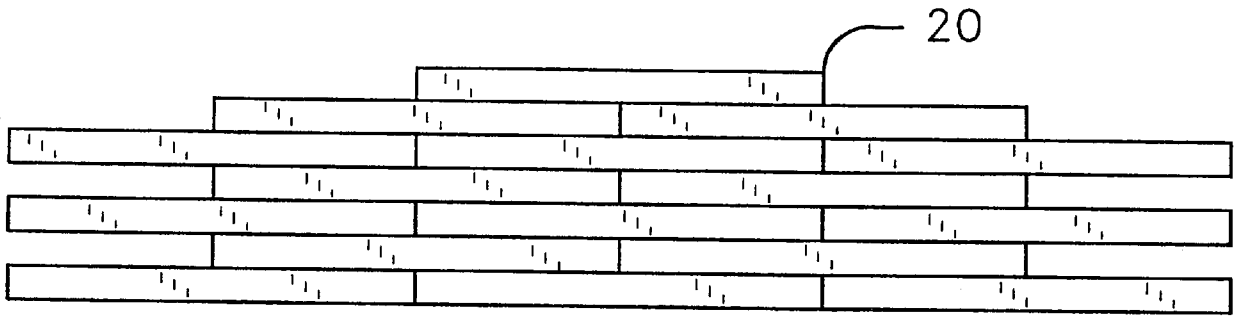
FIG. 2 is a schematic front view of a wall erected using the present invention.
Figure 3:
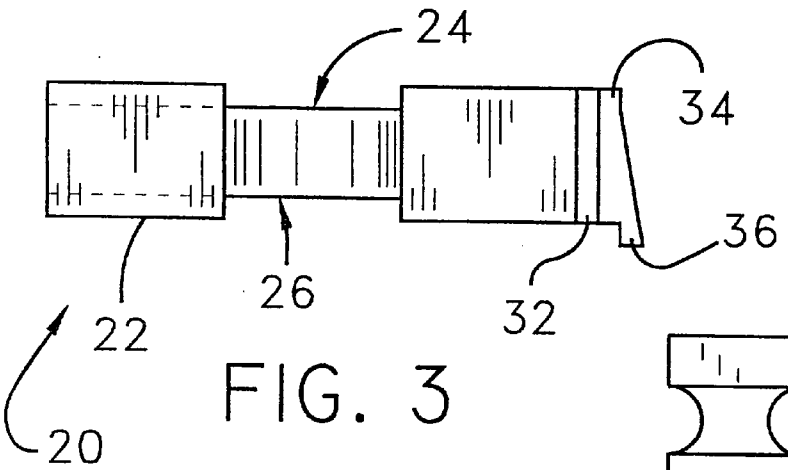
FIG. 3 is a schematic side view of a lateral member of the present invention.
Figure 4:
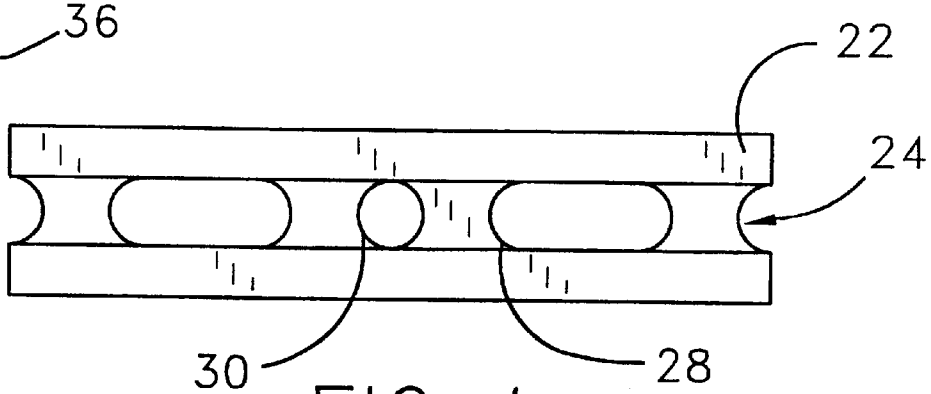
FIG. 4 is a schematic top view of a lateral member of the present invention.
Figure 5:
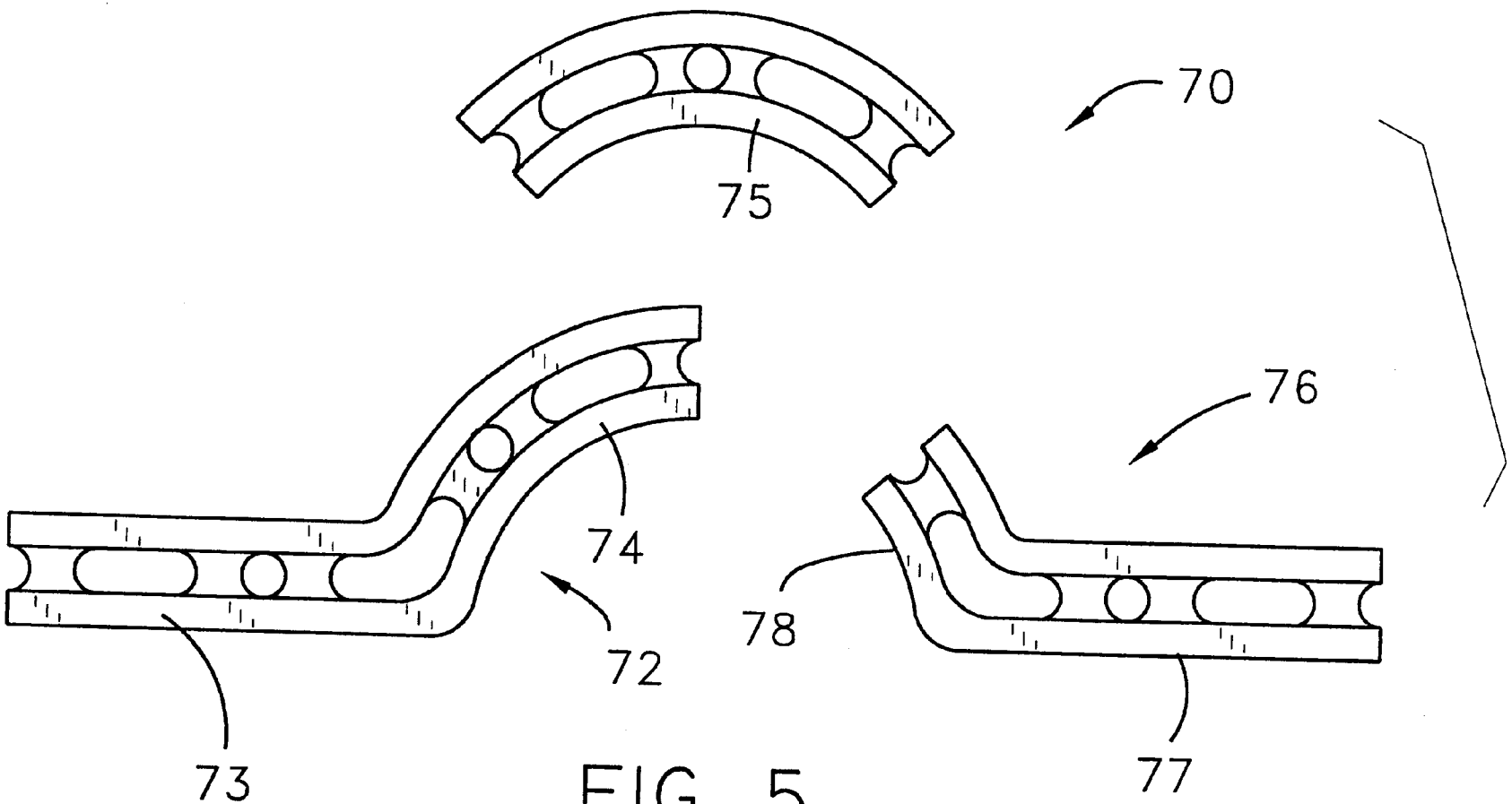
FIG. 5 is a schematic top view of the curved assembly of the present invention.

With reference now to the drawings, and in particular to FIGS. 1 through 6 thereof, a new modular construction system embodying the principles and concepts of the present invention and generally designated by the reference numeral 10 will be described.

As best illustrated in FIGS. 1 through 6, the modular construction system 10 generally comprises a plurality of lateral members 20, a plurality of anchor members 40, a plurality of anchor segments 50, and a plurality of fastener members 60.

Each lateral member 20 is stackable with other lateral members 20. Each lateral member20 is couplable end-to-end with other lateral members 20. Each lateral member 20 includes at least one bore, which extends through the lateral member 20.

Each one of the plurality of anchor members 40 is couplable to a foundation of a building. Each anchor member 40 includes an eye portion 42. Each anchor member 40 provides a mechanical interconnection between the foundation and the modular construction system 10.

Each anchor segment 50 includes a hook portion 52 for engaging the eye portion 42 of the anchor member 40. Each anchor segment 50 includes a cylindrical exterior surface which is threaded. Each plurality of anchor segments 50 is positionable through the bore of the lateral member 20 for securing the lateral members 20 to the foundation.

Each fastener member 60 is threadably couplable to an associated one of the anchor segments 50 to prevent the lateral members 20 from being lifted away from the foundation.

Each one of the plurality of lateral members 20 further comprises a structural portion 22 which is elongate. The structural portion 22 includes a groove 24 positioned along a top surface of the structural portion 22. The groove 24 includes a longitudinal axis positioned substantially parallel to a longitudinal axis of the structural portion 22. The structural portion 22 includes a plurality of elliptical bores 28 extending therethrough. Each one of the elliptical bores 28 extends from a top surface of the structural portion 22 down through a bottom surface of the structural portion 22. Each of the elliptical bores 28 includes an axis positioned substantially perpendicularly to the longitudinal axis of the structural portion 22. The plurality of elliptical bores 28 is positioned in a spaced linear array. The elliptical bores 28 provide weight reduction for the structural member 22. The structural portion 22 provides mechanical strength for the modular construction system 20.

In an embodiment the lateral member 20 includes a second groove 26 positioned along a bottom surface of the structural portion 22. The second groove 26 is positioned such that a longitudinal axis of the second groove 26 is in a spaced substantially parallel relationship with a longitudinal axis of the groove 24.

In a further embodiment the groove 24 and the second groove 26 each has a width of approximately five inches. The groove 24 and the second groove 26 each has a depth of approximately 0.625 inches.

In still a further embodiment each one of the plurality of elliptical bores 28 includes a width of approximately 5 inches and a length of approximately 15 inches. The plurality of elliptical bores 28 is positioned in a space linear array with approximately 9 inches of space between bores 28.

In yet a further embodiment each one of the plurality of structural members 22 includes a plurality of circular bores 30 extending therethrough. Each one of the plurality of circular bores 30 extends from a top surface of the structural members 22 down through a bottom surface of the structural members 22. The circular bores 30 provides weight reduction for the structural member 22.

In still yet a further embodiment each one of the plurality of circular bores 30 includes a diameter of approximately 5 inches. The plurality of circular bores 30 is positioned in a spaced linear array interspersed with the plurality of elliptical bores 28.

In an embodiment each one of the plurality of lateral members 20 further comprises an insulation portion 32, which is coupled to an exterior face of the structural portion 22 of the lateral member 20. The insulation portion 32 inhibits thermal transmissibility between a first side of the lateral member 20 and a second side of the lateral member 20.

A siding portion 34 is coupled to an exterior face of the insulation portion 32 of the lateral member 20. The siding portion 34 provides environmental protection for the lateral member 20.

In an embodiment the siding portion 34 tapers outwardly such that a thickness of the siding member 34 along a top surface of the siding member34 is substantially less than a thickness of the siding member 34 along a bottom surface of the siding member 34.

The siding portion 34 further comprises a lip 36, which extends downward from the bottom surface. The lip 36 is positioned adjacent to a front surface of the siding portion 34. The lip 36 is for promoting the flow of moisture down an exterior surface when the lateral members 20 are stacked. The lip 36 also facilitates alignment of the lateral members 20 when stacked.

A curved assembly 70 is couplable to the lateral members 20. The curved assembly 70 is for forming radius corners and outsets for bay windows.

In an embodiment the curved assembly 70 further comprises a plurality of first 72, second 75, and third curved members 76. Each one of the first curve members 72 includes a lateral portion 73 and an arcuate portion 74. The arcuate portion 74 is integrally coupled to the lateral portion 73. The arcuate portion 74 forms a quarter of a circle. Each one of the second curve members 75 is substantially arcuate. The second curve members 74 form a quarter of a circle. Each one of the third curve members 76 includes a lateral portion 77 and an arcuate portion 78. The arcuate portion 78 is integrally coupled to the lateral portion 76. The arcuate portion 78 forms an eighth of a circle.

In use, a plurality of the lateral members, anchor members, anchor segments, and fastener members are provided. The anchor members are coupled to the foundation. This may be accomplished with a finished foundation or as part of the foundation pouring process. An anchor segment is attached to each one of the anchor members. The anchor segments provide a brace for developing a compressive force between the fastener members and the foundation. Thus the lateral members arc vertically secured to the foundation. A first course of the lateral members is placed over the anchor segments such that a bottom surface of the lateral member rests upon a top surface of the foundation with the anchor members extending upwardly through the circular bores of the lateral members. A secondary course of lateral members is similarly placed over the anchor segments such that a bottom surface of each one of the secondary course of lateral members rests upon a top surface of an associated one of the first course of lateral members with the anchor segments extending upwardly through the circular bores of the secondary course of lateral members. The placement of the secondary courses of lateral members is repeated until the desired height of the wall to be until has been obtained. Each one of the plurality of fastener members is placed on an associated one of the anchor segments. The fastener members are tightened on the anchor segments such that the fastener members provide a compressive force onto the secondary courses of lateral members. Additionally a curved assembly, which is couplable to the lateral members may be provided. The desired placement of a bay window is determined. As required for the dimensions of the bay window, the curved assembly is substituted for the secondary courses of the lateral members for desired height of by window.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A modular construction system for use in the erection of walls and buildings comprising:

a plurality of lateral members, each lateral member being stackable with other lateral members, each lateral member being couplable end-to-end with other lateral members, each lateral member having at least one bore extending therethrough;

a plurality of anchor members couplable to a foundation of a building, each anchor member having an eye portion, each anchor member providing a mechanical interconnection between the foundation and said modular construction system;

a plurality of anchor segments, each anchor segment having a hook portion for engaging said eye portion of said anchor member, each anchor segment having a cylindrical exterior surface, said cylindrical exterior surface having threads applied thereon, each plurality of anchor segments being positionable through said bore of said lateral member for securing said lateral members to said foundation;

a plurality of fastener members, each fastener member being threadably couplable to an associated one of said anchor segments to prevent said lateral members from being lifted away from the foundation;

wherein each one of said plurality of lateral members further comprises a siding portion coupled to an exterior face of an insulation portion of said lateral member, said siding portion providing environmental protection for said lateral member;

said siding portion tapers outwardly such that a thickness of said siding member along a top surface of said siding member is substantially less than a thickness of said siding member along a bottom surface of said siding member; and said siding portion further comprises a lip extending downwardly from said bottom surface, said lip being positioned adjacent to a front surface of said siding member, said lip extending over a top edge of a siding portion of another lateral member positioned below said lateral member, said lip being for promoting the flow of moisture down an exterior surface when said lateral members are stacked, said lip facilitating alignment of said lateral members when stacked.

2. The modular construction system of claim 1, wherein each one of said plurality of lateral members further comprises:

a structural portion being elongate, said structural portion having a groove positioned along a top surface of said structural portion, said groove having a longitudinal axis positioned substantially parallel to a longitudinal axis of said structural portion;

said structural portion having a plurality of elliptical bores extending therethrough, each one of said elliptical bores extending from a top surface of said structural portion down through a bottom surface of said structural portion, each of said elliptical bores having an axis positioned substantially perpendicular to said longitudinal axis of said structural portion, said plurality of elliptical bores being positioned in a spaced linear array, said elliptical bores providing weight reduction for said structural member, said structural portion providing mechanical strength for said modular construction system.

3. The modular construction system of claim 2, further comprising:

said lateral member having a second groove positioned along a bottom surface of said structural portion, said second groove being positioned such that a longitudinal axis of said second groove is in a spaced substantially parallel relationship with a longitudinal axis of said groove.

4. The modular construction system of claim 3, further comprising:

wherein said groove and said second groove each having a width of approximately five inches, said groove and said second groove each having a depth of approximately 0.625 inches.

5. The modular construction system of claim 2, further comprising:

wherein each one of said plurality of elliptical bores having a width of approximately 5 inches and a length of approximately 15 inches, said plurality of elliptical bores being positioned in a space linear array with approximately 9 inches of space between bores.

6. The modular construction system of claim 5, further comprising:

wherein each one of said plurality of structural members having a plurality of circular bores extending therethrough, each one of said plurality of circular bores extending from a top surface of said structural members down through a bottom surface of said structural members, said circular bores providing weight reduction for said structural member.

7. The modular construction system of claim 6, further comprising:

wherein each one of said plurality of circular bores having a diameter of approximately 5 inches, said plurality of circular bores being positioned in a spaced linear array interspersed with said plurality of elliptical bores.

8. The modular construction system of claim 1, wherein each one of said plurality of lateral members further comprises:

an insulation portion coupled to an exterior face of a structural portion of said lateral member, said insulation portion inhibiting thermal transmissibility between a first side of said lateral member and a second side of said lateral member.

9. A modular construction system for use in the erection of walls and buildings comprising:

a plurality of lateral members, each lateral member being stackable with other lateral members, each lateral member being couplable end-to-end with other lateral members, each lateral member having at least one bore extending therethrough;

a plurality of anchor members couplable to a foundation of a building, each anchor member having an eye portion, each anchor member providing a mechanical interconnection between the foundation and said modular construction system;

a plurality of anchor segments, each anchor segment having a hook portion for engaging said eye portion of said anchor member, each anchor segment having a cylindrical exterior surface, said cylindrical exterior surface having threads applied thereon, each plurality of anchor segments being positionable through said bore of said lateral member for securing said lateral members to said foundation;

a plurality of fastener members, each fastener member being threadably couplable to an associated one of said anchor segments to prevent said lateral members from being lifted away from the foundation;

each one of said plurality of lateral members further comprises a structural portion being elongate, said structural portion having a groove positioned along a top surface of said structural portion, said groove having a longitudinal axis positioned substantially parallel to a longitudinal axis of said structural portion; said structural portion having a plurality of elliptical bores extending therethrough, each one of said elliptical bores extending from a top surface of said structural portion down through a bottom surface of said structural portion, each of said elliptical bores having an axis positioned substantially perpendicularly to said longitudinal axis of said structural portion, said plurality of elliptical bores being positioned in a spaced linear array, said elliptical bores providing weight reduction for said structural member, said structural portion providing mechanical strength for said modular construction system;

wherein said lateral member having a second groove positioned along a bottom surface of said structural portion, said second groove being positioned such that a longitudinal axis of said second groove is in a spaced substantially parallel relationship with a longitudinal axis of said groove;

wherein said groove and said second groove each having a width of approximately five inches, said groove and said second groove each having a depth of approximately 0.625 inches;

wherein each one of said plurality of elliptical bores having a width of approximately 5 inches and a length of approximately 15 inches, said plurality of elliptical bores being positioned in a space linear array with approximately 9 inches of space between bores;

wherein each one of said plurality of structural members having a plurality of circular bores extending therethrough, each one of said plurality of circular bores extending from a top surface of said structural members down through a bottom surface of said structural members, said circular bores providing weight reduction for said structural member;

wherein each one of said plurality of circular bores having a diameter of approximately 5 inches, said plurality of circular bores being positioned in a spaced linear array interspersed with said plurality of elliptical bores;

wherein each one of said plurality of lateral members further comprises an insulation portion coupled to an exterior face of said structural portion of said lateral member, said insulation portion inhibiting thermal transmissibility between a first side of said lateral member and a second side of said lateral member;

a siding portion coupled to an exterior face of said insulation portion of said lateral member, said siding portion providing environmental protection for said lateral member;

wherein said siding portion tapers outwardly such that a thickness of said siding member along a top surface of said siding member is substantially less than a thickness of said siding member along a bottom surface of said siding member; and said siding portion further comprises a lip extending downwardly from said bottom surface, said lip being positioned adjacent to a front surface of said siding member, said lip extending over a top edge of a siding portion of another lateral member positioned below said lateral member, said lip being for promoting the flow of moisture down an exterior surface when said lateral members are stacked, said lip facilitating alignment of said lateral members when stacked.

10. The modular construction system of claim 9, further comprising:

a curved assembly couplable to said lateral members, said curved assembly being for forming radius corners and outsets for bay windows.

11. The modular construction system of claim 10 wherein said curved assembly further comprises:

a plurality of first curve members, each one of said first curve members having a lateral portion and an arcuate portion, said arcuate portion being integrally coupled to said lateral portion, said arcuate portion forming a quarter of a circle.

12. The modular construction system of claim 10, wherein said curved assembly further comprises:

a plurality of second curve members, each one of said second curve members being substantially arcuate, said second curve member forming a quarter of a circle.

13. The modular construction system of claim 10, wherein said curved assembly further comprises:

a plurality of third curve members, each one of said third curve members having a lateral portion and an arcuate portion, said arcuate portion being integrally coupled to said lateral portion, said arcuate portion forming an eighth of a circle.

14. A method of erecting a wall comprising:

providing a plurality of lateral members, each lateral member being stackable with other lateral members, each lateral member being couplable end-to-end with other lateral members, each one of said plurality of lateral members further comprises a structural portion being elongate, said structural portion having a groove positioned along a top surface of said structural portion, said groove having a longitudinal axis positioned substantially parallel to a longitudinal axis of said structural portion; said structural portion having a plurality of elliptical bores extending therethrough, each one of said elliptical bores extending from a top surface of said structural portion down through a bottom surface of said structural portion, each of said elliptical bores having an axis positioned substantially perpendicularly to said longitudinal axis of said structural portion, said plurality of elliptical bores being positioned in a spaced linear array, said elliptical bores providing weight reduction for said structural member, said structural portion providing mechanical strength for said modular construction system, each one of said structural portions having a second groove positioned along a bottom surface of said structural portion, said second groove being positioned such that a longitudinal axis of said second groove is in a spaced substantially parallel relationship with a longitudinal axis of said groove, each one of said plurality of structural members having a plurality of circular bores extending therethrough, each one of said plurality of circular bores extending from a top surface of said structural members down through a bottom surface of said structural members, said circular bores providing weight reduction for said structural member, each one of said plurality of lateral members further comprises an insulation portion coupled to an exterior face of said structural portion of said lateral member, said insulation portion inhibiting thermal transmissibility between a first side of said lateral member and a second side of said lateral member, each one of said structural portions having a siding portion coupled to an exterior face of said insulation portion of said lateral member, said siding portion providing environmental protection for said lateral member, said siding portion tapers outwardly such that a thickness of said siding member along a top surface of said siding member is substantially less than a thickness of said siding member along a bottom surface of said siding member, said siding portion further comprises a lip extending downwardly from said bottom surface, said lip being positioned adjacent to a front surface of said siding member, said lip extending over a top edge of a siding portion of another lateral member positioned below said lateral member, said lip being for promoting the flow of moisture down an exterior surface when said lateral members are stacked, said lip facilitating alignment of said lateral members when stacked;

providing a plurality of anchor members couplable to a foundation of a building, each anchor member having an eye portion, each anchor member providing a mechanical interconnection between the foundation and said modular construction system;

providing a plurality of anchor segments, each anchor segment having a hook portion for engaging said eye portion of said anchor member, each anchor segment having a cylindrical exterior surface, said cylindrical exterior surface having threads applied thereon, each plurality of anchor segments being positionable through said bore of said lateral member for securing said lateral members to said foundation;

providing a plurality of fastener members, each fastener member being threadably couplable to an associated one of said anchor segments to prevent said lateral members from being lifted away from the foundation;

coupling each one of said anchor members to the foundation, each anchor being placed in a spaced linear array with approximately 24 inches between anchor members;

connecting each one of said anchor segments to an associated one of said anchor members;

placing a first one of a first course of said lateral members over said anchor segments such that a bottom surface of said lateral member rests upon a top surface of the foundation with said anchor members extending upwardly through said circular bores of said lateral members;

placing a second lateral member of said first course over said anchor segments such that said second lateral member is positioned substantially end to end with said first lateral member;

repeating placement of second lateral members until the desired length of the wall to be built has been obtained;

placing a secondary course of lateral members over said anchor segments such that a bottom surface of each one of said secondary course of lateral members rests upon a top surface of an associated one of said first course of lateral members with said anchor segments extending upwardly through said circular bores of said secondary course of lateral members;

repeating placement of said secondary courses of lateral members until the desired height of the wall to be until has been obtained;

placing each one of said plurality of fastener members on an associated one of said anchor segments;

tightening said fastener members on said anchor segments such that said fastener members provide a compressive force onto the secondary courses of lateral members.

15. The method of erecting a wall of claim 10 further comprising:

providing a curved assembly couplable to said lateral members, ;said curved assembly being for forming radius corners and outsets for bay windows, said curved assembly further comprises a plurality of first curve members, a plurality of second curve members, and a plurality of third curve members, each one of said first curve members having a lateral portion and an arcuate portion, said arcuate portion being integrally coupled to said lateral portion, said arcuate portion forming a quarter of a circle, each one of said second curve members being substantially arcuate, said second curve member forming a quarter of a circle, each one of said third curve members having a lateral portion and an arcuate portion, said arcuate portion being integrally coupled to said lateral portion, said arcuate portion forming an eighth of a circle;

determining the desired placement of a bay window;

substituting said curved assembly for said secondary courses of said lateral members for desired height of by window.

16. The wall erected by the method of claim 14.

17. The wall erected by the method of claim 15.

* * * * *